US007039976B2

(12) United States Patent
Sears

(10) Patent No.: US 7,039,976 B2
(45) Date of Patent: May 9, 2006

(54) BRAKING CONTROL SYSTEM FOR A WASHING MACHINE

(75) Inventor: Jeffrey L. Sears, Grinnell, IA (US)

(73) Assignee: Maytag Corporation, Newton, IA (US)

( * ) Notice: Subject to any disclaimer, the term of this patent is extended or adjusted under 35 U.S.C. 154(b) by 395 days.

(21) Appl. No.: 10/118,259

(22) Filed: Apr. 9, 2002

(65) Prior Publication Data

US 2003/0188389 A1 Oct. 9, 2003

(51) Int. Cl.
*D06F 33/02* (2006.01)

(52) U.S. Cl. ..... 8/159; 68/12.14; 68/23.3; 68/12.06

(58) Field of Classification Search ..... 68/12.02, 68/12.06, 12.14, 19, 23 R, 23.3; 8/158, 159
See application file for complete search history.

(56) References Cited

U.S. PATENT DOCUMENTS 2,018,474 A * 10/1935 Tholl ..... 210/366
2,147,420 A * 2/1939 Baker et al. ..... 384/199
2,344,253 A * 3/1944 Kirby ..... 68/12.01
2,503,438 A * 4/1950 Gruner ..... 318/364
2,572,265 A * 10/1951 Johnson ..... 192/30 R
2,597,405 A * 5/1952 Tholl ..... 384/465
2,604,771 A * 7/1952 De Remer ..... 68/25
2,645,108 A * 7/1953 Smith ..... 68/23.2
2,671,331 A * 3/1954 Jackson ..... 68/23 R
2,838,954 A * 6/1958 Higley ..... 494/82
3,049,025 A * 8/1962 Lannert ..... 74/574
3,068,966 A * 12/1962 Knapmeyer ..... 188/170
3,114,705 A * 12/1963 Prihonic et al. ..... 210/145
3,226,016 A * 12/1965 Couper et al. ..... 494/7
3,285,419 A * 11/1966 Smith ..... 210/144
3,306,082 A * 2/1967 Hasegawa et al. ..... 68/12.01
3,327,507 A * 6/1967 Landon ..... 68/24
3,356,222 A * 12/1967 Belaieff ..... 210/363
3,369,663 A * 2/1968 Serrell ..... 210/781
3,412,621 A * 11/1968 Jacobs ..... 74/721
3,635,318 A 1/1972 Anthony
4,411,664 A 10/1983 Rickard et al.
4,513,464 A 4/1985 Rettich et al.
4,631,771 A 12/1986 Anderson et al.
4,765,161 A 8/1988 Williamson
4,843,671 A 7/1989 Hirooka et al.
4,991,247 A * 2/1991 Castwall et al. ..... 8/158
5,171,435 A 12/1992 Nishimura et al.
5,207,081 A * 5/1993 Fuse ..... 68/23.1
5,301,523 A 4/1994 Payne et al.

(Continued)

FOREIGN PATENT DOCUMENTS

DE 3425509 * 1/1986

(Continued)

*Primary Examiner*—Frankie L. Stinson
(74) *Attorney, Agent, or Firm*—Diederiks & Whitelaw, PLC

(57) ABSTRACT

An inner tub of a washing machine is rapidly braked during a portion of a deceleration phase following an extraction phase of an overall spin cycle. A controller establishes the braking operation over a critical speed band or resonant frequency zone during which excessive vibrations would be developed. The critical speed band is preferably determined based on one or more signals received from speed, load, and/or out-of-balance sensors.

20 Claims, 2 Drawing Sheets

U.S. PATENT DOCUMENTS

| | | | | |
|---|---|---|---|---|
| 5,325,677 | A | | 7/1994 | Payne et al. |
| 5,507,054 | A | | 4/1996 | Blauert et al. |
| 5,647,232 | A | | 7/1997 | Boldt et al. |
| 5,829,277 | A | | 11/1998 | Wunderlich |
| 5,913,952 | A | | 6/1999 | Kim |
| 5,937,467 | A | | 8/1999 | Kim |
| 6,151,930 | A | * | 11/2000 | Carlson ..... 68/12.06 |
| 6,220,063 | B1 | | 4/2001 | Wunderlich et al. |

FOREIGN PATENT DOCUMENTS

| | | | |
|---|---|---|---|
| FR | 2 531 461 | * | 2/1984 |
| JP | 58-6094 | * | 1/1983 |
| JP | 2-71797 | * | 3/1990 |
| JP | 4-38994 | * | 2/1992 |
| JP | 5-269292 | * | 10/1993 |

* cited by examiner

BRAKING CONTROL SYSTEM FOR A WASHING MACHINE

BACKGROUND OF INVENTION

1. Field of Invention

The present invention pertains to the art of washing machines, and more particularly, to a control system for braking an inner tub of a washing machine through a critical speed range within which an out-of-balance condition could occur, such that the washing machine is not exposed to high vibration levels.

2. Discussion of Prior Art

Typical washing machines perform a wash cycle by agitating or tumbling a load of clothes bathed in a water or water/detergent solution within an inner tub. After the wash cycle has completed, a spin cycle, including an extraction phase and a deceleration phase, is required. Most machines perform this cycle by spinning the inner tub at a high rate such that centrifugal forces cause the water or water/detergent solution to separate from the clothes. After a predetermined period has elapsed, drive to the inner tub is disrupted whereby the inner tub is slowly brought to a stop.

It is well known in the art that, prior to the extraction or dehydration phase, the clothes can become unevenly distributed within the inner tub. During the extraction phase of the spin cycle, the uneven distribution of the clothes results in an out-of-balance condition which causes excessive vibration of the machine. For this reason, it is known to incorporate out-of-balance sensors in washing machines to determine the presence of such a condition which can be counteracted such that the effects caused by the vibrations are reduced. While these corrective measures are effective, they focus on the extraction phase of the spin cycle, as opposed to the deceleration phase of the cycle. However, during the deceleration phase, an out-of-balance condition can cause the machine to experience similar vibration problems as during the extraction phase of the spin cycle. Accordingly, based on at least these reasons, there exists a need in the art for a braking system which will effectively and efficiently reduce the effects of vibration on a washing machine, thereby enhancing the effective life of the machine and protecting its various components.

SUMMARY OF THE INVENTION

The present invention is directed to a system and method for effectively braking an inner tub or spinner of a washing machine following an extraction phase of a spin cycle to reduce the amount of time the inner tub is near the resonant frequency of the machine. Experience has shown that an out-of-balance condition will occur within a discrete or critical speed band during deceleration (assuming a generally consistent load size). Therefore, if the inner tub is caused to rapidly pass through the critical speed band during braking, the effects of high vibrations due to an unbalanced load is substantially eliminated. To this end, in accordance with the invention, a control system is incorporated into the washing machine to rapidly decelerate the inner tub through the critical speed band, preferably by applying a short burst of braking force, e.g., a pulsed braking force, to reduce the impact on electronic control components.

In accordance with the invention, an out-of-balance sensor is provided to sense the onset of an unbalance condition. The sensor will signal a controller which will operate a brake to rapidly decelerate the inner tub. More particularly, in one preferred embodiment, the controller is configured to intermittently operate the brake to slow the inner tub through the critical speed band such that component life can be extended. In another preferred embodiment, the brake control of the present invention is incorporated into systems having a mechanical brake. As mechanical braking systems are exposed to potential damage when subjected to excessive or extreme out-of-balance conditions, the present invention preferably provides for intermittent operation of the mechanical brake to aid in handling unbalanced loads.

In a still further preferred form of the embodiment, the control system of the present invention will "learn" the location of the critical speed band during a spin cycle in which an out-of-balance condition is likely to occur for any given load size. The location will be stored in a memory including a "look-up" table such that the control will activate the brake over a known discrete speed band in order to reduce the impact of an out-of-balance condition.

Based on the above, it should be apparent that the system of the present invention relies upon one or more specific dynamic variables of the washing machine in order to accurately and effectively control the braking of the inner tub, such that the washing machine is not exposed to excessive vibrations. In any event, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE INVENTION

Figure 1:
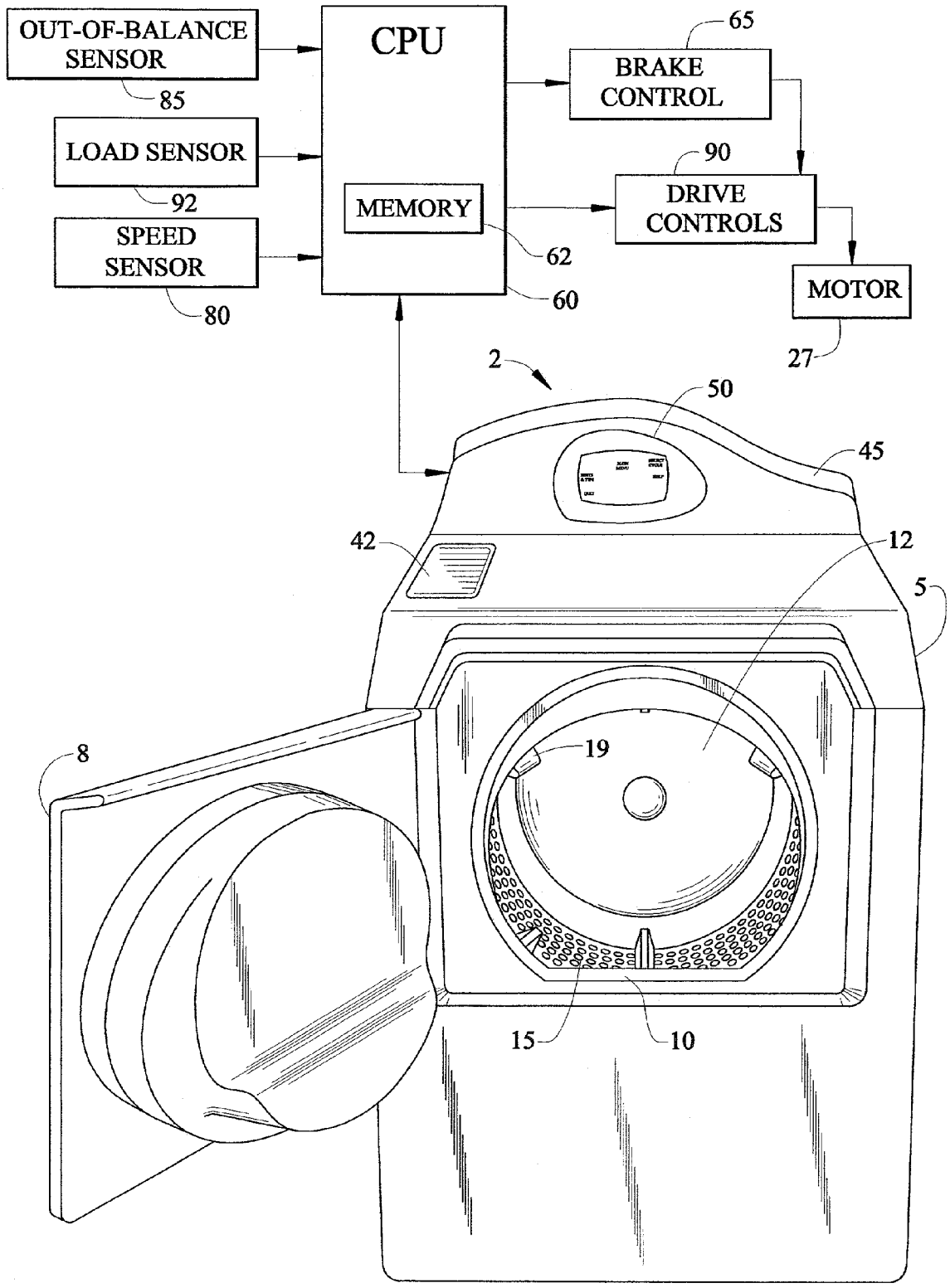
FIG. 1 is a perspective view of a horizontal axis washing machine incorporating the braking control system of the present invention.

With initial reference to FIG. 1, an automatic horizontal axis washing machine incorporating the braking control system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which articles of clothing are laundered.

As is known in the art, inner tub 12 is formed with a plurality of holes 15 and multiple, radially inwardly projecting fins or blades 19 are fixedly secured to inner tub 12. Inner tub 12 is mounted for rotation within an outer tub (not shown) which, in turn, is supported through a suspension mechanism (also not shown) within cabinet shell 5. Inner tub 12 is mounted within cabinet shell 5 for rotation about a generally horizontal axis. A motor 27, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, a detergent/water solution, or another washing fluid supplied within inner tub 12.

The general construction and basic operation of washing machine 2 is known in the art and not considered an aspect of the present invention. Therefore, a full description of its construction will not be set forth here. However, for the sake of completeness, automatic washing machine 2 is also shown to include an upper cover 42 that provides access to an area for adding detergent, softeners and the like. In addition, an upper control panel 45, including an LCD touch screen display 50, is provided for manually setting a desired washing operation.

The present invention is particularly directed to the manner in which a rotational speed of inner tub 12 is controlled during a critical period following an extraction phase of a spin cycle. To this end, FIG. 1 also illustrates one preferred control system embodiment in accordance with the present invention. As shown, washing machine 2 incorporates a central processing unit (CPU) 60 which preferably includes a memory 62. As will also be detailed fully below, CPU 60 functions to regulate a brake control 65 for inner tub 12. In the embodiment shown, CPU 60 is adapted to receive signals from an inner tub speed sensor 80 and an out-of-balance sensor 85. As will also be detailed more fully below, CPU 60 actually functions to regulate brake control 65, drive controls 90 and, at least indirectly, motor 27. As further discussed more fully below, CPU 60 can receive signals from a load sensor as generally indicated at 92. At this point, it should be noted that speed, out-of-balance, and load sensors for washing machines are well known in the art. In any event, the particular construction of each of these sensors is not important in connection with the present invention and therefore will not be detailed further here.

After the articles of clothing placed within inner tub 12 for laundering are subjected to a washing phase wherein the clothes will be tumbled within inner tub 12, a spin cycle of an overall washing operation will be initiated. A similar spin cycle will also be performed following each rinse cycle. In any event, during an extraction or dehydration phase of each spin cycle, inner tub 12 will be rotated at relatively high speeds, e.g., speeds up to and exceeding 700 rpm as is known in the art, such that the water or water/detergent solution is caused to separate from the clothes. After extraction, a deceleration phase takes place wherein drive to inner tub 12 is terminated through drive control 90. During the extraction phase, out-of-balance sensor 85 can be used to monitor for the onset of an out-of-balance condition. That is, if the clothes are unevenly distributed, out-of-balance sensor 85 will send a signal to CPU 60. If the out-of-balance condition exceeds a predetermined threshold, CPU 60 can respond by modifying the operation of washing machine 2, such as by lowering the maximum rotational speed for inner tub 12 for future cycles, as known in the art.

In any event, after the water or water/detergent solution is extracted from the clothing, a deceleration period for inner tub 12 is initiated. Therefore, motor 27 will be deactivated through drive control 90 and inner tub 12 is caused to decelerate. It is at this point that the present invention is actually employed. In accordance with the invention, as inner tub 12 decelerates, out-of-balance sensor 85 continuously monitors for the presence of an unbalanced condition. When out-of-balance sensor 85 detects an unbalanced condition during this deceleration phase, a signal is sent to CPU 60. Essentially simultaneously with the receipt of the out-of-balance signal, CPU 60 will send a braking signal to brake control 65 in order to rapidly reduce the rotational speed of inner tub 12. In general, experience has shown that a critical speed band will exist over an intermediate portion of the deceleration phase. It is during this portion that out-of-balance conditions are prevalent based on an average load and machine design parameters. In any event, as signals are continuously received from out-of-balance sensor 85, brake control 65 need only be activated by CPU 60 through the critical speed band.

Most preferably, the signals received from out-of-balance sensor 85 reflect an incipient out-of-balance condition such that an actual state of unbalance need never actually be reached. In accordance with the embodiment of FIG. 1, activation of the brake preferably constitutes altering the operation of motor 27. More specifically, motor 27 is either operated in reverse, or at a speed substantially lower than the current speed of rotation of inner tub 12, in order to rapidly reduce the rotational speed of inner tub 12 through the speed range that exhibits the out-of-balance condition. Regardless, instead of simply allowing inner tub 12 to coast to a stop or applying some constant braking force, the present invention assures that the speed of inner tub 12 is rapidly reduced through the critical speed band or range during which an out-of-balance condition would exist.

Although CPU 60 could operate in accordance with the invention based only on the signals received from out-of-balance sensor 85 for a current washing operation, speed sensor 80 also preferably sends signals representative of the speed at which the unbalanced condition occurs. In accordance with a preferred embodiment of the invention, the unbalance and speed signals are stored in non-volatile memory 62 for later use. That is, the stored information is used in connection with the invention to better determine an incipient unbalanced condition. In general, as indicated above, a substantially consistent critical speed range will be established for an average load size and a given washing machine construction/operation. In any event, by storing this information, CPU 60 can actually contain a "look-up" table used to anticipate an out-of-balance condition and take pre-unbalance measures to avoid the condition.

Of course, tests could be simply run for a particular washing machine, with CPU 60 having pre-stored in memory 62 the critical speed range for the application of rapid deceleration. Therefore, CPU 60 effectuates braking when inner tub 12 approaches an unbalanced state based on "learned" parameters, with these parameters either being learned in pre-testing prior to selling washing machine 2 to a consumer or during actual use by the consumer. As indicated above, CPU 60 can also receive signals from and store in memory 62 the weight of a particular washing load. In this case, over time, CPU 60 will acquire a plurality of speed and load parameters which relate to sensed out-of-balance parameters. This information can readily be used to identify a particular critical speed band for rapid braking dependent on the weight of the load. Therefore, in this manner, a critical speed band can be established for discrete load weights such that braking is achieved without exposing the machine to any undue vibration.

Figure 2:
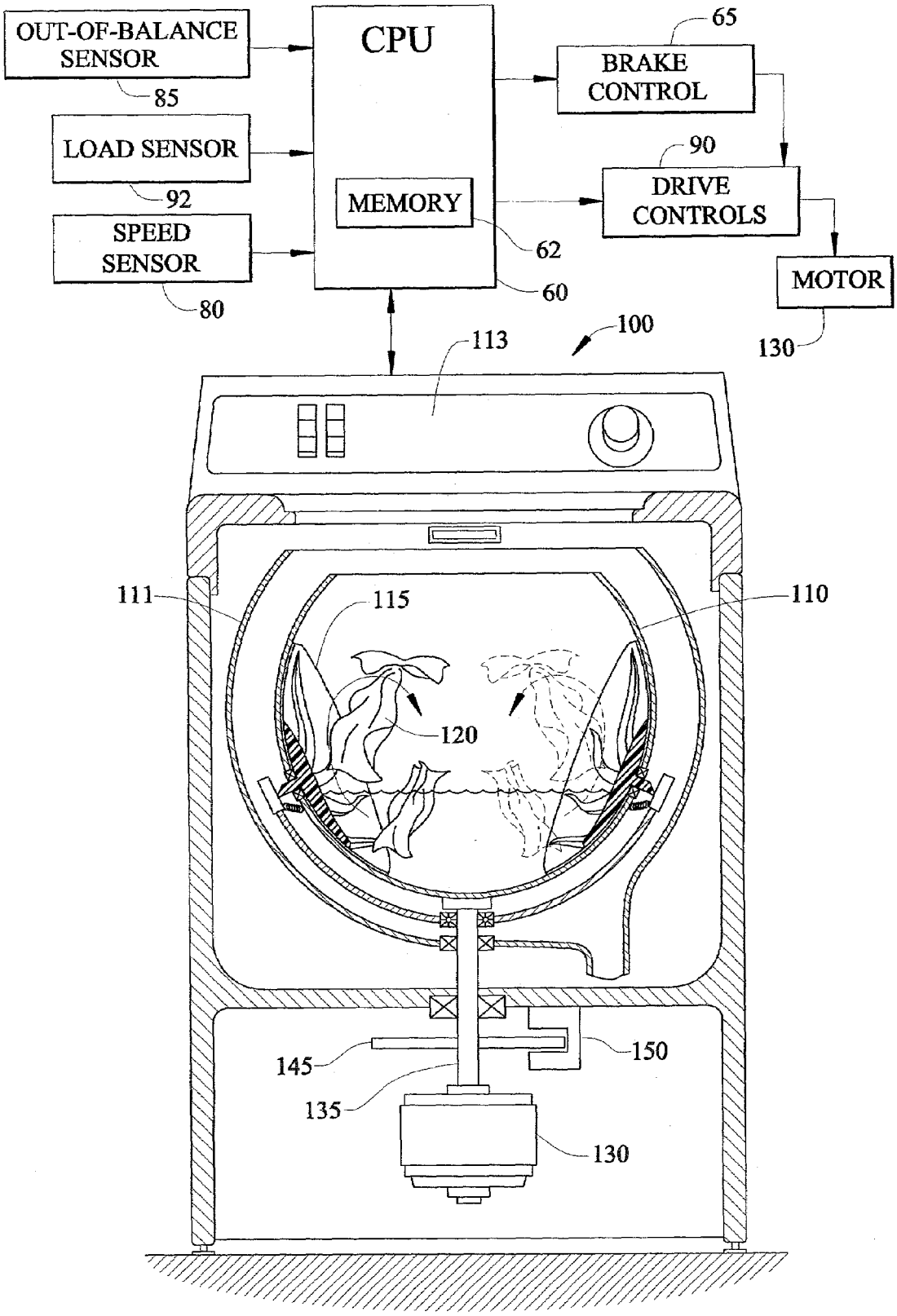
FIG. 2 is a partially cut away view of a vertical axis washing machine, including a spherical spinner, multiple agitators and a direct drive system, incorporating the braking control system of the present invention.

As indicated above, the preferred embodiment disclosed with reference to FIG. 1 controls motor 27 to establish the required braking. However, other braking arrangements could be equally employed. FIG. 2 depicts a vertical axis washing machine 100 which utilizes another type of braking arrangement. As the general structure and operation of washing machine 100 are known in the art (details being found in U.S. Pat. Nos. 5,829,277 and 6,220,063 which are incorporated herein by reference), these details will not be reiterated here. However, washing machine 100 is shown to include a generally spherical inner tub 110, a substantially spherical outer tub 111, and a control panel 113. A pair of agitators 115 are mounted within inner tub 110 and are provided to cause clothes 120 to effectively shift within inner tub 110 during a washing operation. Inner tub 110 is drivingly connected to a motor 130 through a driveshaft 135. More importantly, in connection with the present invention, washing machine 100 is shown to include a mechanical braking system including a brake disc 145 and a brake caliper 150.

In a manner corresponding to that set forth with respect to the first embodiment described above, washing machine 100 can be controlled to rapidly brake through a critical speed band or range during a deceleration phase of a spin cycle. Due to the directly analogous structure and function with the embodiment of FIG. 1, common reference numerals have been utilized in FIG. 3 to depict the corresponding structure. In any event, the main difference between the embodiment of FIG. 1 and that of FIG. 3 is that brake control 65 controls caliper 150 in the latter embodiment. Since, in all other respects, the two embodiments are the same, a complete reiteration of the overall operation will not be provided here. Instead, it is simply important to note that the invention can be applied to both vertical and horizontal axis washing machines and the braking function can be performed in various ways. Therefore, it should be realized that the examples set forth herein are not intended to limit the methods of or structure for braking that can be used in connection with the present invention. It should also be realized that the braking operation can be achieved through the use of a consistent or uniform braking force, or an intermittent force could be applied through the critical period. In any event, the invention is only intended to be limited by the scope of the following claims.

I claim:

1. A washing machine comprising:

a cabinet shell;

an outer tub mounted within the cabinet shell;

an inner tub rotatably mounted within the cabinet shell, said inner tub being adapted to receive articles of clothing which are to be subjected to a washing operation including at least a wash cycle and a spin cycle, with the spin cycle including an extraction phase during which the inner tub is rotated to dehydrate the articles of clothing, and a subsequent deceleration phase during which a rotational speed of the inner tub is decreased;

a motor drivingly connected to the inner tub, said motor being adapted to rotate the inner tub during at least the extraction phase of the spin cycle;

means for establishing a critical period of the deceleration phase for any given load size, with said critical period defining a critical speed range within which an out-of-balance condition is expected to occur; and braking means for rapidly decelerating the inner tub during the critical period, wherein the inner tub is caused to rapidly pass through the critical speed range such that the washing machine is not subject to high vibration levels.

2. The washing machine of claim 1, wherein the critical period occurs during an intermediate portion of the deceleration phase.

3. The washing machine of claim 2, wherein the braking means is intermittently activated through the critical speed range.

4. The washing machine of claim 2, wherein the braking means operates the motor in reverse.

5. The washing machine of claim 1, wherein the motor includes a driveshaft drivingly interconnecting the motor to the inner tub and the braking means includes a brake disc fixedly mounted to the driveshaft.

6. The washing machine of claim 1, further comprising: means for sensing an onset of the critical period.

7. The washing machine of claim 6, wherein the sensing means includes an out-of-balance sensor.

8. A washing machine comprising:

a cabinet shell;

an inner tub rotatably mounted within the cabinet shell, said inner tub being adapted to receive articles of clothing which are to be subjected to a washing operation including at least a wash cycle and a spin cycle, with the spin cycle including an extraction phase during which the inner tub is rotated to dehydrate the articles of clothing, and a subsequent deceleration phase during which a rotational speed of the inner tub is decreased, wherein the deceleration phase includes a critical speed range during which excessive vibrations can develop for any given load size in the washing machine; and brake means for rapidly decelerating the inner tub during at least a portion of the critical speed range of the deceleration phase for the current washing operation.

9. The washing machine of claim 8, wherein the critical period occurs during an intermediate portion of the deceleration phase.

10. The washing machine of claim 9, wherein the brake means is intermittently activated through the critical speed range.

11. The washing machine of claim 9, wherein the brake means includes a motor drivingly connected to the inner tub, said brake means constituting operating the motor in reverse.

12. The washing machine of claim 8, wherein the brake means includes a brake disc fixed for rotation with the inner tub.

13. A method of operating a washing machine during a spin cycle comprising;

spinning an inner tub during an extraction phase of the spin cycle to extract a wash liquid from a wash load in the inner tub; and decelerating the inner tub during a deceleration phase of the spin cycle including:

decelerating the inner tub at a first rate for a first portion of the deceleration phase;

determining a critical period, including a critical speed range of the deceleration phase, within which an out-of-balance condition can occur for any given load size;

rapidly decelerating the inner tub at a second rate during the critical period such that the inner tub is caused to quickly pass through the critical speed range; and allowing the inner tub to come to rest.

14. The method according to claim 13, further comprising: decelerating the inner tub at a third rate for a third period, after which the inner tub is allowed to come to rest.

15. The method according to claim 13, further comprising: activating a mechanical brake during at least a portion of the critical period.

16. The method according to claim 15, further comprising: intermittently activating the brake during the at least the portion of the critical period.

17. The method according to claim 13, further comprising: sensing an incipient out-of-balance condition to determine the critical period.

18. A method of performing a washing operation on articles of clothing comprising:

placing articles of clothing within an inner tub;

subjecting the clothes to a wash cycle;

initiating an extraction phase of a spin cycle constituting spinning the inner tub to extract wash liquid from the articles of clothing;

entering a deceleration phase of the spin cycle;

rapidly decelerating the inner tub during an intermediate portion of the deceleration phase to proactively avoid an incipient unbalance condition washing for any given load size; and terminating the washing operation.

19. The method according to claim 18, further comprising: intermittently activating a brake during the intermediate portion of the critical period.

20. The method according to claim 18, further comprising: sensing an incipient out-of-balance condition to determine the critical period.

* * * * *